United States Patent [19]

Lou

[11] Patent Number: 4,684,568

[45] Date of Patent: Aug. 4, 1987

[54] VAPOR-PERMEABLE LIQUID-IMPERMEABLE FABRIC

[75] Inventor: Gene W. Lou, Newark, Del.

[73] Assignee: E. I. Du Pont de Nemours and Company, Wilmington, Del.

[21] Appl. No.: 854,211

[22] Filed: Apr. 21, 1986

[51] Int. Cl.[4] ..... B05D 3/02; B05D 3/12; B32B 7/00; B32B 27/00

[52] U.S. Cl. ..... 428/265; 427/365; 427/366; 427/389.9; 428/290; 428/341; 428/913

[58] Field of Search ..... 427/365, 366, 389.9, 427/246; 428/394, 395, 340, 341, 265, 290, 913

[56] References Cited

U.S. PATENT DOCUMENTS

| | | | |
|---|---|---|---|
| 3,121,657 | 2/1964 | Magill | 161/159 |
| 3,421,960 | 1/1969 | Arbit | 156/244 |
| 3,501,326 | 3/1970 | Hochberg et al. | 117/76 |
| 3,871,910 | 3/1975 | Barkis et al. | 427/365 X |
| 3,914,479 | 10/1975 | Yamagata et al. | 428/290 |
| 4,029,833 | 6/1977 | Kosta | 427/428 |
| 4,347,844 | 9/1982 | Ohki et al. | 428/325 X |

FOREIGN PATENT DOCUMENTS

| | | |
|---|---|---|
| 0004480 | 2/1982 | European Pat. Off. . |
| 2541327 | 8/1984 | France . |
| 952667 | 3/1964 | United Kingdom . |

*Primary Examiner*—Michael R. Lusignan

[57] ABSTRACT

A process is provided for making a water-impermeable, vapor-permeable fabric. A lightweight continuous coating of polypropylene resin is applied to the surface of a fibrous sheet to make the sheet impermeable to water and vapor. Subsequent calendering provides vapor permeability to the sheet while maintaining liquid water impermeability. The resultant product is particularly suited for use as a roofing-tile underlayment or as an air-infiltration barrier.

6 Claims, 2 Drawing Figures

VAPOR-PERMEABLE LIQUID-IMPERMEABLE FABRIC

BACKGROUND OF THE INVENTION

1. Field of the Invention

This invention reIates to a process for making a fabric that has specific barrier properties and to the product of that process. More particulary, the invention concerns such a process in which a lightweight continuous coating of polypropylene is applied to a fibrous base sheet and then calendered to produce a fabric that is permeable to vapor and impermeable to liquid.

2. Description of the Prior Art

Fabrics that are vapor-permeable and water-impermeable have long been sought for a wide variety of uses. Strong fabrics having such transmission and barrier characteristics would be particularly useful in building construction, for example as a roofing-tile underlayment (i.e., "underslatement") or as an air-infiltration barrier which reduces heat losses through walls, ceilings and around joints.

Many methods have been suggested for obtaining fabrics that are relatively water impermeable and vapor permeable. For example, woven or nonwoven fabrics have been coated with polymeric materials that are filled with substances which cause the polymeric material to form fissures, when the coated fabric is worked or heated or when the filler is dissolved from the structure. Also, various types of foamed coatings and coated poromeric structures have been suggested. However, when used as a roofing tile underlayment or as an air-infiltration barrier, the prior art materials have exhibited shortcomings in their combination of strength, barrier and transmission properties.

The object of the present invention is to provide a process for making a coated fabric that would be suitable for use as an air-infiltration barrier or as a roofing-tile underlayment The invention also comprehends the new fabric made thereby.

SUMMARY OF THE INVENTION

The present invention provides a process for preparing a vapor-permeable, liquid-water-impermeable fabric which includes the steps of applying a continuous coating of polypropylene to a surface of a vapor-and-liquid-permeable, base sheet of synthetic organic fibers and then calendering the coated surface. The polypropylene coating has a melt flow rate of at least 30 and weighs in the range of 5 to 15 g/m$^2$. The calendering is performed at a sufficient temperature and under a sufficient load to increase the moisture vapor transmission of the coated fabric to at least 200 g/m$^2$/day while obtaining a hydrostatic head of at least 20 cm. In a preferred embodiment,

- the fibrous base sheet has an initial moisture vapor transmission of at least 500, most preferably in the range of 700 to 1000, and a hydrostatic head of less than 10, most preferably less than 5, and is composed essentially of polypropylene or polyester filaments having a dtex per filament in the range of 1 to 20, most preferably 2 to 12, and weighs in the range of 50 to 150 g/m$^2$,
- the polypropylene coating has a melt flow rate in the range of 45 to 130, weighs 7 to 11 g/m$^2$, and when applied to the base fabric reduces the moisture vapor transmission of the fabric to less than 100, usually to less than 50 g/m$^2$/day, and

- the calendering is performed under conditions of temperature and load which increase the moisture vapor transmission of the coated sheet to at least 400, while maintaining the hydrostatic head of the sheet at no less than 30 cm.

Preferably, the coating application step of the process is carried out by extrusion coating and the calendering step is carried out in the nip formed by a heated smooth roll and a non-heated back-up roll. Preferably, the coating is subjected to a nip load in the range of 1,400 to 3,000 Newtons/linear cm and a calender roll temperature in the range of 135° C. to 155° C.

The present invention also provides a vapor-permeable, liquid-water-impermeable fabric which can be made by the above-described process. The fabric comprises

- a coated fibrous base sheet of polypropylene or polyester filaments weighing in the range of 50 to 150 g/m$^2$, the filaments having a dtex per filament in the range of 1 to 20,
- and at least one flat surface of the fibrous base sheet having a calendered coating layer of polypropylene which has a melt flow rate in the range of 30 to 150, the coating layer having a unit weight in the range of 5 to 15 g/m$^2$ and containing a multiplicity of small pores which permit substantial flow of gas but prevent substantial flow of liquid water.

Preferably, the coated and calendered sheet has a moisture vapor transmission of at least 200 g/m$^2$/day, most preferably at least 400, and a hydrostatic head of at least 20 cm, most preferably at least 30.

BRIEF DESCRIPTION OF THE DRAWING

The invention will be more fully understood by reference to attached drawing in which

FIG. 1, which depicts the coating step, shows a fibrous base sheet 1 being fed from supply roll 10 under screw melt-extruder 20. Extruder 20 supplies polypropylene polymer 2 through a slit orifice to deposit a thin continuous coating on the surface of sheet 1. The sheet is supported on roll 30 as the coating is applied. Coated sheet 3 is then advanced to windup as roll 40. Then, as shown in FIG. 2, which depicts the calendering step, coated sheet 3 is fed from roll 40 to a calendering nip, which is formed by heated roll 50 and unheated backup roll 60, and then under chill roll 70 to form ooated and calendered sheet 4, which is finally wound up as roll 80. Although the coating and calendering steps are depicted as separate operations in the drawing, the steps can be performed as a continuous process.

DETAILED DESCRIPTIONS OF PREFERRED EMBODIEMENTS

As used herein, the term "vapor-permeable" means that a sheet or fabric has a moisture vapor transmission of at least 200 g/m$^2$/day, and the term "liquid-water-impermeable" means that a sheet or fabric has a resistance to liquid water transmission as measured by a hydrostatic head of at least 20 cm. A "liquid-permeable" sheet has a hydrostatic head of less than 10 cm, and usually of less than 5. Also, as usede herein, the term "fibers" includes continuous filaments as well as staple fibers.

Suitable fibrous base sheets for use in the process of the present invention include woven and nonwoven sheets that are permeable to both vapor and liquid water. Nonwoven sheets of continuous filaments of synthetic organic polymer, particularly of polypropylene or polyester, are preferred, though woven sheets of slit films or tapes can also be used. When nonwoven spunbonded sheets of polypropylene or polyester filaments are employed, the dtex per filament is usually in the range of 1 to 20, with a range of 2 to 12 being preferred. The weight of such suitable spunbonded sheets is usually in the range of 50 to 125 g/m$^2$. The starting fibrous base sheets usually have a moisture vapor transmission (MVT) of at least 500 g/m$^2$/day. The preferred MVT of the base sheet is in the range of 700 to 1,000. The starting sheet exhibits a very low hydrostatic head, generally of less than 10 cm, and preferably of less than 5. The starting fibrous base sheet also supplies the basic strength characteristics properties to the final coated and calendered product of the invention.

Polypropylene coating resins that are suitable for use in the present invention are generally of high melt flow rate (MFR). Usually the resins have an MFR of at least 45 and of less than 150, but the preferred MFR range is 45 to 130.

Figure 1:
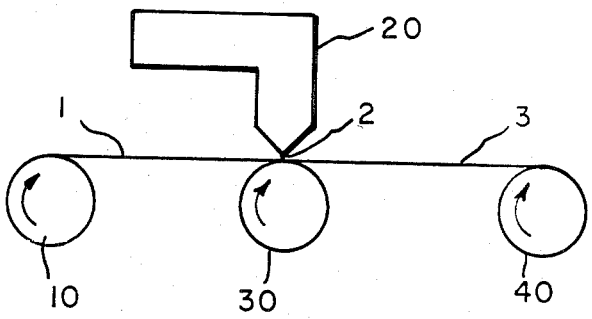
FIGS. 1 and 2 are schematic diagrams of equipment suitable for carrying out of the key steps of the process of the invention.
Figure 2:
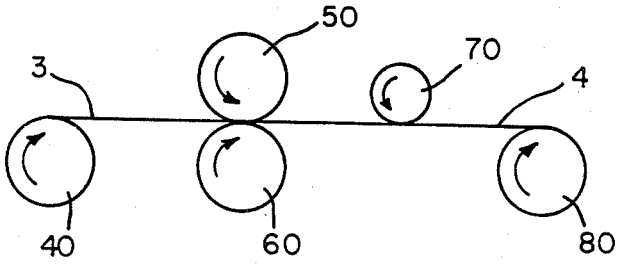

The polypropylene resin can be applied to the fibrous base sheet by means of known melt-extrusion coating apparatus, such as depicted in FIG. 1. In accordance with the invention however, the polypropylene resin must be applied as a substantially continuous lightweight coating. The weight of the coating is usually in the range of 5 to 15 g/m$^2$, which corresponds to a coating thickness of only 5.6 to 16.7 micrometers. The continuous coating makes the base sheet impermeable to vapor and liquid water. Generally, the coated sheet exhibits an MVT of less than 50 g/m$^2$/day, often less than 30, and a hydrostatic head of at least 20 cm, often higher than 50 and sometimes even higher than 100 cm After the sheet has been made impermeable to both liquid and vapor by the coating step, careful adjustment of the conditions in the next step of the process, the calendering step, surprisingly can result in a final product that is permeable to moisture vapor but is impermeable to liquid water. For the calendering step, a conventional calender such as that depicted in FIG. 2 is suitable. The heated roll may have a smooth polished surface or an etched surface, such as is known on Schreiner rolls. The surface temperature of the heated roll which comes in contact with the coated surface of the fibrous sheet usually is in the range of 135° to 155° C. The load applied by the calender to the coated sheet is usually in the range of 1,400 to 3,000 Newtons per linear centimeter of nip breadth. The exact temperature and load conditions depend on the speed of the calendering, as well as on the MFR and weight of the polypropylene coating. However, these calendering conditions can be determined quite readily by a few trials with "handsheet" samples of the coated sheet. Samples measuring for example, about 0.5×1 meter are suitable for these conditions-selection tests The resultant products of the just-described process have the characteristics set forth in the summary of the invention and illustrated in detail in the examples below. The sheets, being vapor-permeable, liquid-impermeable and strong, are particularly suited for use as underslatement and building air-infiltration barriers. The coated surfaces are can be printed upon and if desired can be further modified (with regard to printability, adhesion and barrier properties somewhat) by flame treatment or corona discharge treatment.

The various sheet, polymer, fiber and product characteristics referred to in the text and in the Examples below are measured by the following methods. In the test method descriptions, TAPPI refers to the Technical Association of Pulp and Paper Industry, ASTM refers to the American Society of Testing Materials and AATCC refers to the American Association of Textile Chemists and Colorists. Although most measurements were made in "English" units, all values are reported in metric units.

Melt flow rate ("MFR") of polypropylene polymer is measured in accordance with ASTM D 1238L and is reported in grams per 10 minutes.

Unit weight is measured in accordance with ASTM D 3776-86 and reported in grams/square meter.

Tensile strengths and trapezoidal tear strengths in the longitudinal direction (also called "MD" or machine direction) and in the transverse direction (also called "XD" or cross-machine direction) are measured in accordance with ASTM D-1117-80 and are reported in Newtons. The tensile strengths are also referred to as sheet grab tensile (SGT) strengths.

Mullen burst is measured in accordance with ASTM D 3786-80A and reported in kiloPascals.

Moisture vapor transmission is measured in accordance with TAPPI T4480om-84 and reported in grams per square meter per day.

Hydrostatic head, a measure of the liquid water permeability of a sheet or fabric, is measured in accordance with AATCC Method 127 and is reported in centimeters.

EXAMPLE 1

This example describes how a spunbonded nonwoven sheet of polypropylene filaments was coated with a polypropylene resin and then calendered in accordance with the present invention to form a vapor-permeable, water-impermeable fabric. Equipment of the type depicted in FIG. 1 and 2 was used to carry out the process. Characteristics of the starting fibrous base sheet and of the final product of the example are given in Table I below. The final fabric was particularly suited for use as a roof-tile underlayment.

The fibrous base sheet of this example was "TYPAR" spunbonded polypropylene, Style 3301-B, available from E. I. Du Pont de Nemours and Company, Old Hickory, Tennessee. The sheet was made in accordance with the general description given in Example 1 of Lou and Zimmerman, U.S. Pat. No. 4,582,750, and was supplied as a roll of 2.16-meter-wide sheet. The sheet was composed of polyproylene filaments that had a dtex per filament of 11.

A polypropylene coating resin, "Tenite" 4G7DP, available from Eastman Chemical Products, Inc., Kingsport, Tenn., having a nominal melt flow rate of 50 grams/10 minutes and containing 0.3% Chimasorb 944 and 0.1% Irganox B225 (both Ciba-Geigy stabilizers), was extrusion-coated onto the surface of the fibrous base starting sheet. The coating conditions included a melt temperature of 293° C., a distance of 5 cm between the exit of the slit orifice and the surface of the fibrous base sheet, a coating add-on weight of 10.3 g/m$^2$, a chill roll temperature of 10° C. and a sheet speed of 229 m/min. The polypropylene resin formed a continuous coating. The coated sheet was substantially impermeable to vapor and liquid water; it had a moisture vapor transmission of less than 40 g/m$^2$/day and a hydrostatic head of greater than 50 cm. The coated sheet was then trimmed and slit to form two 1.07-meter-wide rolls.

A roll of the slit, coated sheet was then calendered in the nip formed between a smooth, polished metal roll and a back-up roll of 100% cotton fabric of 90 Shore A hardness. The metal roll was heated to a surface temperature of 152° C. The back-up roll was not heated. A load of 2800 Newtons per linear centimeter was applied to the sheet as the sheet advanced through the calendering nip at a speed of 13.7 meters/min. The characteristics of the resultant coated-and-calendered sheet are compared with those of the starting sheet in the following table. Note that resultant fabric has again become permeable to moisture vapor but is still impermeable to liquid water.

TABLE I

| | Starting Sheet | Resultant Fabric |
|---|---|---|
| Unit weight, g/m$^2$ | 102 | 112 |
| Sheet grab tensile, Newtons | | |
| MD | 534 | 605 |
| XD | 490 | 579 |
| Trapezoidal tear, Newtons | | |
| MD | 204 | 99 |
| XD | 231 | 145 |
| Mullen burst, kPascals | 827 | 372 |
| Moisture vapor transmission, g/m$^2$/day | 910 | 244 |
| Hydrostatic head, cm | <2 | 30 |

The above-described procedures were repeated with two lighter weight starting sheets of the same general type and with the same polypropylene coating resin. The dtex per filament of the first (sample 1-a) was 11 and of the second (sample 1-b) was 4.4. After coating and calendering the sheets had the following permeability characteristics:

| | Weight, g/m$^2$ | | Product | |
|---|---|---|---|---|
| Sample | Sheet | Coating | MVT | HH |
| 1-a | 85 | 11.4 | 220 | 25 |
| 1-b | 58 | 6.9 | 460 | 35 |

EXAMPLE 2

This invention illustrates that a range of permeability and barrier characteristics can be achieved by use of the process of the present invention. In this example, three series of tests are described in which vapor-and-liquid-permeable spunbonded sheets of continuous polyproplene filaments are coated with different amounts of polypropylene coating resins having different melt flow rates, after which the sheets are calendered. These tests show that although the coating can make the starting sheet impermeable to vapor and liquid water, calendering under sufficient temperature and load surprisingly can make the sheet permeable to vapor again and still retain its ability to be substantially impermeable to liquid water.

The starting sheet for this example was a 67.8-g/m$^2$ spunbonded sheet of continuous polypropylene filaments having a dtex per filament of about 4.4. The sheet was made by the general method described in Example 1, except that filaments in each of the four sheet layers were randomly, rather than directionally, disposed. The starting sheet was highly permeable to vapor and liquid water, having a moisture vapor transmission of 942 g/m$^2$/day and a hydostatic head of less than 8 cm Three polypropylene coating resins were used in the tests. The melt flow rate of the resin in test series 1 was 48; in series 2, 68; and in series 3, 116. Six levels of coating add-on were employed for each test series, with samples 1 through 6 respectively in each series being coated with 5.7, 6.4, 7.6, 8.2, 9.6 and 11.7 g/m$^2$.

The equipment used for coating and calendering the test samples was of the same general design as that used in example 1. Coating conditions included a melt temperature of 288° C. and adjustment of the sheet speed to meter the desired amount of coating resin onto the sheet. Sheet speed was 117 meters/min for the heaviest coating add-ons and 241 m/min for the lightest coatings. In each test a continuous coating was applied to the surface of the spunbonded starting sheet. Calendering was performed with a nip load of 2320 N/cm, a calendering-roll surface temperature of 145° C., a chill-roll surface temperature of 10° C. and a sheet speed of 27.4 m/min.

In each test, the sheet was impermeable to vapor and liquid water after coating. The coated sheet samples each had moisture vapor tansmission of less than 25 g/m$^2$/day and a hydostatic head of at least 20 cm. Calendering of the coated sheets in accordance with the invention unexpectedly increased the moisture vapor transmission of the sheets significantly but still permitted the sheets to retain good liquid water barrier properties. Results of these tests are summarized in Table II. In the table, MVT is moisture vapor transmission and HH is hydrostatic head. As noted above, the MVT and HH of the starting sheet were respectively 940 g/m$^2$/day and less than 8 cm and of the coated sheets before calendering were less than 24 g/m$^2$/day and greater than 50 cm.

Note that test samples A-2 through A-6, B-1, B-5 and B-6, although possessing good "water-proofing" characteristics lacked sufficient moisture vapor transmission to be desired for underslatement or air-infiltration barrier applications and are included in the example for comparison purposes. Test samples C-4 and C-6 are also included for comparison purposes; these samples also would not be desired for use as underslatements or air-infiltraction barriers because of their low hydrostatic head, but could be useful as filtration fabrics.

TABLE II

| Results of Example 2 Tests | | | |
|---|---|---|---|
| | Coating | Product | |
| Test No. | Weight g/m$^2$ | MVT g/m$^2$/d | HH cm |
| Series A MFR = 48 | | | |
| A-1 | 5.7 | 200 | 66 |
| A-2 | 6.4 | 110 | 79 |
| A-3 | 7.6 | 100 | 86 |
| A-4 | 8.2 | 70 | 86 |
| A-5 | 9.6 | 50 | 89 |
| A-6 | 11.7 | 20 | 86 |
| Series 2 MFR = 68 | | | |
| B-1 | 5.7 | 90 | 86 |
| B-2 | 6.4 | 200 | 91 |
| B-3 | 7.6 | 580 | 79 |
| B-4 | 8.2 | 550 | 97 |
| B-5 | 9.6 | 100 | 69 |
| B-6 | 11.7 | 40 | 79 |
| Series 3 MFR = 116 | | | |
| C-1 | 5.7 | 860 | 28 |

TABLE II-continued

| Test No. | Results of Example 2 Tests: Coating Weight g/m² | Product MVT g/m²/d | Product HH cm |
|---|---|---|---|
| C-2 | 6.4 | 900 | 36 |
| C-3 | 7.6 | 880 | 36 |
| C-4 | 8.2 | 890 | 13 |
| C-5 | 9.6 | 870 | 30 |
| C-6 | 11.7 | 900 | 10 |

EXAMPLE 3

This example further demonstrates the versatility of the present invention in providing coated sheets having various combinations of vapor permeability and liquid impermeability. The procedure of Example 2 was repeated with the 68-MFR polypropylene coating resin and with two different starting sheets. The first sheet was of randomly disposed polypropylene filaments of 2.8 dtex/fil, prepared in the same manner as described above, except that only one type of filament was present in the sheet (i.e., there were no binder filament segments). This sheet was used for Test 3-1. The second starting sheet, which was used for test 3-2, was a spunboonded sheet of randomly disposed polyester filaments of 2.4 dtex/fil. The composition of the polyester filaments included 91% of poly(ethylene terephthalate) filaments and 9% of poly(ethylene terephthalate/isothalate) 90/10 copolymer filaments. The copolyester filaments act as binder filaments for the sheet. Table III compares the resultant products of this example with Sample B-3 of Example 2. The listed strengths are means of the longitudinal and transverse values.

TABLE III

| Test No. | B-3 | 3-1 | 3-2 |
|---|---|---|---|
| Starting Sheet | | | |
| Weight, g/m² | 68 | 68 | 68 |
| dtex/fil | 4.4 | 2.8 | 2.4 |
| MVT, g/m²/d | 940 | 580 | 570 |
| HH, cm | 8 | 10 | 13 |
| Coated Sheet | | | |
| Coating, g/m² | 7.6 | 7.6 | 7.6 |
| MVT | 35 | 27 | 24 |
| HH | 84 | 99 | 102 |
| Coated and Calendered Sheet | | | |
| SGT, Newtons | 178 | 169 | 320 |
| Tear, Newtons | 10.7 | 16.0 | 15.1 |
| MVT | 580 | 550 | 540 |
| HH | 79 | 91 | 97 |

The results summarized in Table III, as well as those of the preceding examples, show that the invention can be used quite readily with a variety of substrates to provide strong fabrics that are permeable to moisture vapor and impermeable to liquid water.

I claim:

1. A process for preparing a vapor-permeable, liquid-water-impermeable fabric which consists essentially of the steps of applying a continuous coating of polypropylene to a surface of a vapor-and-liquid-permeable, fibrous base sheet and then calendering the coated surface, the polypropylene coating having a melt flow rate of at least 30 and amounting to a unit weight in the range of 5 to 15 g/m², and the calendering being performed at a sufficient temperature and under a sufficient load to increase the moisture vapor transmission of the coated fabric to at least 200 g/m²/day while obtaining a hydrostatic head of at least 20 cm.

2. A process in accordance with claim 1 wherein the fibrous base sheet has an initial moisture vapor transmission in the range of at least 500 and a hydrostatic head of less than 10 and is composed essentially of polypropylene or polyester filaments having a dtex per filament in the range of 1 to 20 and weighs in the range of 50 to 150 g/m², the polypropylene coating has a melt flow rate in the range of 45 and 130, amounts to a unit weight of 7 to 11 g/m², and when applied to the base fabric surface reduces the moisture vapor transmission of the fabric to less than 100, and the calendering is performed under conditions of temperature and load to increase the moisture vapor transmission of the coated sheet to at least 400g/m²/day while maintaining its hydrostatic head at a value of at least 30 cm.

3. A process in accordance with claim 2 wherein the fibrous base sheet has a moisture vapor transmission in the range of 700 to 1000, a hydrostatic head of no more than 5, and filaments of polypropylene having a dtex per filament in the range of 2 to 12.

4. A process in accordance with claim 1, 2 or 3 wherein the calendering is performed with a nip load in the range of 1400 to 3000 Newtons per linear centimeter and a calender roll surface temperature in the range of 135° to 155° C.

5. A vapor-permeable, liquid-water-impermeable fabric which consists essentially of a coated fibrous base sheet of polypropylene or polyester filaments weighing in the range of 50 to 125 g/m², the filaments having a dtex per filament in the range of 1 to 20, and at least one flat surface of the fibrous base sheet having a calendered coating layer of polypropylene which has a melt flow rate in the range of 30 to 150, the coating layer having a unit weight in the range of 5 to 15 g/m² and containing a multiplicity of small pores which permit substantial flow of gas, but prevent substantial flow of liquid water, the fabric having a moisture vapor transmission of at least 200 g/m²/day and a hydrostatic head of at least 20 cm.

6. A fabric in accordance with claim 5 having a moisture vapor transmission of at least 400 g/m²/day and a hydrostatic head of at least 30 cm.

* * * * *